US005323996A

United States Patent [19]

Rendall

[11] Patent Number: 5,323,996

[45] Date of Patent: Jun. 28, 1994

[54] BRACKET WITH GRIPPING CLOSED BANDS

[76] Inventor: Thomas E. Rendall, 125 Elm St., San Mateo, Calif. 94401

[21] Appl. No.: 977,529

[22] Filed: Nov. 17, 1992

[51] Int. Cl.[5] ..... A47F 5/00

[52] U.S. Cl. ..... 248/315; D6/546; 248/205.3; 248/206.2; 248/206.5

[58] Field of Search ..... 248/315, 316.1, 309.1, 248/206.5, 206.2, 205.3; 211/87; D6/546, 547, 548

[56] References Cited

U.S. PATENT DOCUMENTS

| | | | |
|---|---|---|---|
| 253,392 | 2/1882 | Jones et al. . | |
| 365,555 | 6/1887 | Tolman . | |
| 380,309 | 4/1888 | Berliner . | |
| 435,752 | 9/1890 | Ingersoll . | |
| 1,077,027 | 10/1913 | Austin . | |
| 1,228,649 | 6/1917 | Childs . | |
| 1,483,640 | 2/1924 | Manning . | |
| 1,636,364 | 7/1927 | Hoegger . | |
| 1,773,815 | 8/1930 | Hoegger . | |
| 1,891,048 | 12/1932 | Keefe . | |
| 1,922,900 | 8/1933 | Plante | 248/205.5 X |
| 1,975,303 | 10/1934 | Walker et al. . | |
| 2,042,804 | 6/1936 | Ridgers . | |
| 2,044,520 | 6/1936 | Weiant, Jr. . | |
| 2,131,224 | 9/1938 | Kaack . | |
| 2,148,401 | 2/1939 | Ellis, Jr. . | |
| 2,231,230 | 10/1939 | Sturtz . | |
| 2,296,073 | 9/1942 | Walgo . | |
| 2,302,300 | 5/1940 | Davies . | |
| 2,303,502 | 12/1942 | Rous . | |
| 2,309,121 | 10/1940 | Keely . | |
| 2,385,977 | 10/1945 | Farmer . | |
| 2,430,238 | 11/1947 | Moorefield | 248/315 |
| 2,502,714 | 7/1947 | Garnett . | |
| 2,505,899 | 6/1947 | Jobe . | |
| 2,576,873 | 11/1951 | Zelov | 248/315 X |
| 2,621,880 | 6/1949 | Wester . | |
| 2,701,114 | 2/1955 | Donaldson | 248/315 |
| 2,815,919 | 10/1954 | Pribil . | |
| 2,891,348 | 3/1958 | Blagg . | |
| 3,101,567 | 8/1963 | Stiller . | |
| 3,309,052 | 3/1967 | Borisof . | |
| 3,592,431 | 7/1971 | Daldone | 248/317 X |
| 3,608,853 | 9/1971 | Sertich | 248/363 X |
| 3,675,886 | 7/1972 | Kampmier | 248/363 |
| 3,713,614 | 1/1973 | Taylor | 248/206.5 X |
| 3,866,873 | 2/1975 | Bohli . | |
| 3,879,005 | 4/1975 | Flick . | |
| 3,976,274 | 8/1976 | Langguth | 248/363 |
| 4,279,396 | 7/1981 | Bendock . | |
| 4,398,692 | 8/1983 | Macfie | 248/307.1 |
| 4,416,438 | 11/1983 | King | 248/102 |

(List continued on next page.)

*Primary Examiner*—Ramon O. Ramirez
*Attorney, Agent, or Firm*—Flehr, Hohbach, Test, Albritton & Herbert

[57] ABSTRACT

A bracket for removably fastening a flexible web article to a generally planar support surface. The bracket includes first and second generally closed bands of approximate equivalent size adapted to grip the flexible web article and fastening element adapted for engagement with the support surface for affixing the closed bands thereto. The fastening element includes a first side portion having a surface adapted to attach to the support surface and an opposite second side portion which carries the closed bands in juxtaposition to each other. In one embodiment, the closed bands, in the form of two planar rings, are coupled to the second side portion in an abutted position to permit pivoting of each ring about the second side portion. In a second embodiment, an attachment band is carried by the second side portion and loops through two planar rings to fasten them to the fastening element. In a third embodiment, an attachment band which loops through two planar rings is swivelably coupled to the second side portion.

23 Claims, 3 Drawing Sheets

U.S. PATENT DOCUMENTS

| | | | |
|---|---|---|---|
| 4,456,210 | 6/1984 | McBride | 248/205.5 |
| 4,779,829 | 10/1988 | Rocke et al. | 248/206.2 |
| 4,813,640 | 3/1989 | Perentin | 248/205.8 |
| 4,813,641 | 3/1989 | Wilson | 248/206.2 |
| 4,844,395 | 7/1989 | Perentin | 248/205.8 |
| 4,846,429 | 7/1989 | Scheurer et al. | 248/205.8 |
| 4,850,556 | 7/1989 | Otani et al. | 248/206.2 |
| 4,867,402 | 9/1985 | Benson et al. | 248/206.2 |
| 4,881,746 | 11/1989 | Andreesen | 280/33.992 |
| 4,907,771 | 3/1990 | Wang | 248/222.1 |
| 4,951,909 | 8/1990 | Russo et al. | 248/206.2 |
| 4,962,907 | 10/1990 | Gary | 248/205.3 |
| 5,026,012 | 6/1991 | Wang | 248/222.1 |
| 5,028,026 | 7/1991 | Phillips et al. | 248/206.2 |
| 5,039,045 | 8/1991 | Adams et al. | 248/206.2 |
| 5,076,523 | 12/1991 | Wang | 248/222.1 |
| 5,078,356 | 1/1992 | Adams | 248/206.2 |
| 5,080,309 | 1/1992 | Ivins | 248/205.8 |
| 5,087,005 | 2/1992 | Holoff et al. | 248/205.8 |
| 5,104,076 | 4/1992 | Goodall, Jr. | 248/205.2 |
| 5,104,077 | 4/1992 | Liu | 248/205.8 |
| 5,110,078 | 5/1992 | Gary | 248/206.2 |
| 5,114,106 | 5/1992 | Daugherty et al. | 248/206.4 |
| 5,133,524 | 7/1992 | Liu | 248/205.8 |
| 5,137,238 | 8/1992 | Hutten | 248/206.3 |
| 5,140,713 | 8/1992 | Pesterfield | 4/575.1 |
| 5,141,191 | 8/1992 | Coffield | 248/206.3 |

BRACKET WITH GRIPPING CLOSED BANDS

BACKGROUND OF THE INVENTION

1. Field of the Invention

This invention relates to a support for affixing articles to relatively planar surfaces and more particularly to a bracket for removably attaching flexible web articles to vertical or horizontal surfaces.

2. Description of the Prior Art

Brackets have been provided for removably attaching flexible web articles such as towels or cloths to relatively planar surfaces. However, in general, these brackets do not fasten the article to the surface in a manner which precludes removal thereof by simply grasping the article. In fact, most towel and cloth racks are designed to permit ease of removal of the towel or cloth. Fastening devices have been provided which restrict removal of the article when grasped, but often require holes be formed in the article for hooking it to the device or that the article be tied about or similarly altered for attachment to the device. Still other fastening devices cannot be removably attached to the planar surface without scarring the surface and/or cannot be used for fastening the article to horizontal surfaces. Some of these devices, despite their techniques for retaining the article, allow the article to be easily removed from the device by children.

As can be seen from the foregoing, there is a need for a new and improved bracket for attaching towels, cloths and similar webbed articles to relatively planar surfaces which overcomes the disadvantages of the foregoing.

Of course, overlapping rings of the type disclosed herein have been used in belts and backpacks, but there has been no suggestion for using such rings for the purpose discussed herein.

SUMMARY OF THE INVENTION

A primary object of the present invention is to provide a bracket for removably fastening a flexible web article to a vertical or horizontal support surface.

Another object of the invention is to provide a bracket of the above character which does not require the formation of holes or similar deformations in the article for fastening it to the bracket.

Another object of the invention is to provide a bracket of the above character which can be removably attached to the support surface.

Another object of the invention is to provide a bracket of the above character which is of a simple design.

These and other objects are achieved in accordance with the invention by providing a bracket for removably fastening a flexible web article to a generally planar support surface. The bracket includes first and second generally closed bands of approximate equivalent size adapted to grip the flexible web article and fastening means adapted for engagement with the support surface for affixing the closed bands thereto. The fastening means includes a first side portion having a surface adapted to attach to the support surface and an opposite second side portion which carries the closed bands in juxtaposition to each other.

In one embodiment, the closed bands, in the form of two planar rings, are coupled to the second side portion in an abutted position to permit pivoting of each ring about the second side portion. In a second embodiment, an attachment band is carried by the second side portion and loops through two planar rings to fasten them to the fastening means. In a third embodiment, an attachment band which loops through two planar rings is swivelably coupled to the second side portion.

In its preferred embodiment, the bracket is removably attached to the support surface by a suction cup. In other embodiments, the first side portion includes an adhesive or magnetic surface to permit removable attachment of the bracket to the support surface.

DETAILED DESCRIPTION OF THE PREFERRED EMBODIMENTS

Figure 1:
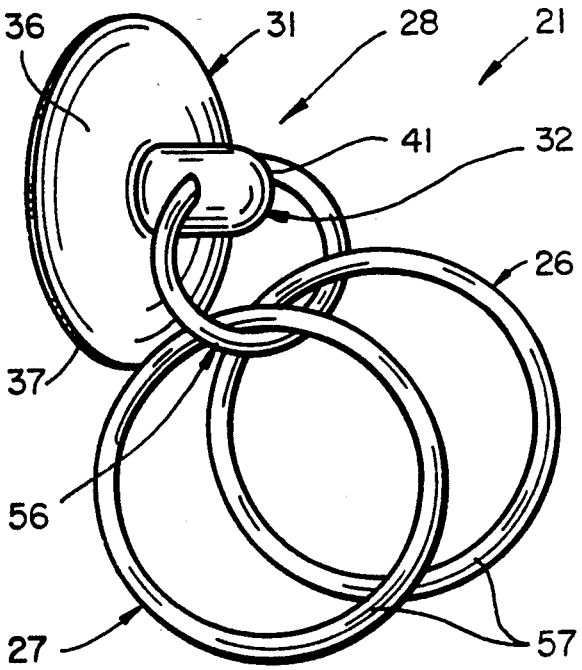
FIG. 1 is an isometric view of the bracket with gripping closed bands of the present invention.
Figure 2:
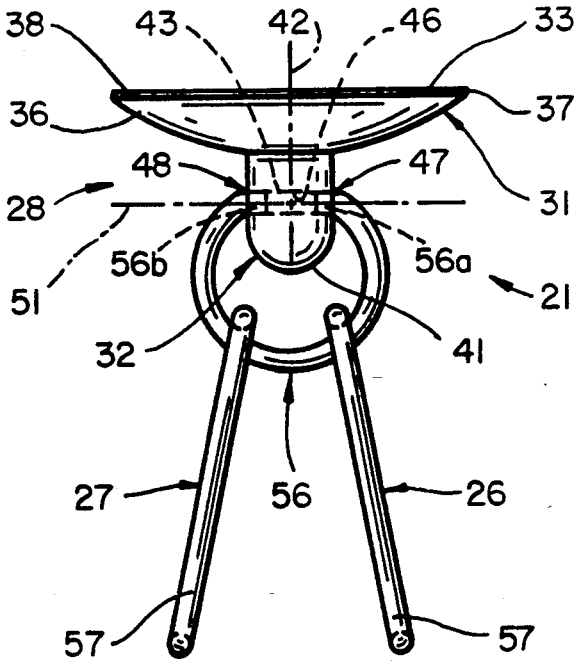
FIG. 2 is a top view of the bracket with gripping closed bands shown in FIG. 1.

Turning now to the drawings, more particularly to FIGS. 1 and 2, there is shown a bracket 21 in accordance with the invention. Bracket 21 is used for removably fastening a flexible web article, such as a cloth 22 having an end portion **22*a* and a central portion 22*b*, to a generally planar horizontal support surface 23 such as a wall or an appliance. The bracket may also be used on horizontal surfaces such as floors and ceilings, as well as inclined surfaces such as automobile bodies or windshields. Bracket 21 is generally circular in plan and is comprised of first and second planar gripping rings 26 and 27, which are of approximate equivalent size and adapted to grip cloth 22, and a fastening means in the form of mounting element 28, which is adapted for engagement with support surface 23** for affixing the rings thereto.

Mounting element 28 is made of a suitable material such as plastic, wood or metal and has a first side portion in the form of disk 31 for removably attaching mounting element 28 to support surface 23 and a second side portion in the form of button 32 which is elongate and extends outwardly from first side portion 31. Disk 31 is generally flat in conformation and circular in plan, and has opposite first and second side surfaces 33 and 36 separated by a circular edge 37. First surface 33 is planar and has a magnet or magnetic layer 38 thereon which serves as means for removably attaching mounting element 28 to support surface 23. Second surface 36 is generally arcuate, with button 32 extending from the center thereof and being approximately perpendicular to first surface 33. Button 32 is generally cylindrical in shape, has a bulbous end 41 which is opposite disk first surface 33 and is provided with a central axis 42. Button is also provided with a transverse bore 43 therethrough formed by inner surface 46 and having opposite first and second openings 47 and 48. Bore 43 is substantially parallel to first surface 33 and is centered on axis 51. Inner surface 46 is generally circular in cross-section.

Mounting element 28 includes an attachment band or ring 56 which is carried by button 32 and loops through each of rings 26 and 27 for securing them to button 32. Attachment ring 56 is generally rigid and is made of a suitable material such as plastic, wood or metal. Attachment ring 56 is generally circular in shape and cross-section, having first and second end portions **56*a* and 56*b* which define an opening therein. End portions 56*a* and 56*b* are disposed in first and second openings 47 and 48 of button bore 43, with inner surface 46 serving as means for pivotly mounting attachment ring 56 to button 32 to permit pivoting of attachment ring 56 in opposite first and second directions about bore axis 51. As so mounted in button 32, attachment ring 56 and button 32** define a closed loop.

Gripping rings 26 and 27 are each formed from a generally and preferably closed band 57. Each band is generally circular in cross-section. It should be appreciated, however, that bands which are not closed could be used in bracket 21 and be within the scope of the present invention. In addition, bands 57 could be rectangular, oblong or have other shapes and/or cross-sections and be within the scope of the present invention.

Figure 3:
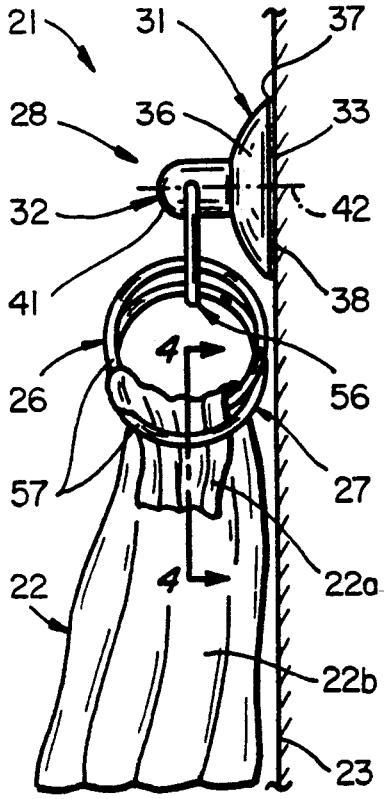
FIG. 3 is a side elevational view of the bracket with gripping closed bands shown in FIG. 1 in use on a horizontal surface.

In operation and use, bracket 21 is mounted to a desired horizontal, vertical or inclined metallic support surface 23 by abutting magnetic layer 38 of first surface 33 against the support surface. When bracket 21 is so mounted to a vertical support surface 23, as illustrated in FIG. 3, cloth 22 can be attached to bracket 21 by first looping cloth end portion **22*a* upwardly behind and then through second (or far) and first (or near) rings 27 and 26 which are in juxtaposition to each other. First ring 26 is then moved off center from second ring 27 and cloth end portion 22*a* slipped around band 57 of first ring 26, between bands 57 of first and second rings 26 and 27 and then downwardly behind second ring 27 so that a cloth fold 22*c* is formed around the encircled portion of first ring band 57 and at least a part of cloth end portion 22*a* extends downwardly from bracket 21 in juxtaposition with cloth central portion 22*b* (See FIG. 4**).

When rings 26 and 27 are in this offset position as shown in FIG. 3, first ring band 57 is no longer generally supported by first ring 26 resting directly on attachment ring 56. Instead, first ring 26 is being supported by cloth fold **22*c*, which in turn is supported by second ring 27 still resting on attachment band 56. As first ring 26 is pulled downwardly toward a centered and aligned position with second ring 27, by the force of gravity on cloth 22 and ring 26 and/or by the tugging on cloth central portion 22*b*, cloth end portion 22*a* is sandwiched between bands 57 of rings 26 and 27 and thereby restricted from slipping out from between the bands. The harder one tugs on cloth central portion 22*b*, the greater the cinching force exerted by first ring 26 on cloth end portion 22*a*. Because rings 26 and 27 are of approximately equivalent size, first ring 26 cannot be pulled through second ring 27** to relieve this cinching force.

Figure 4:
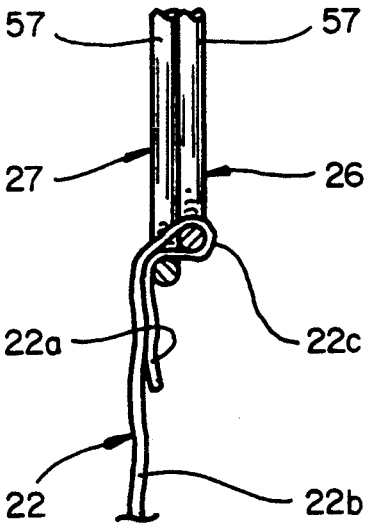
FIG. 4 is a cross-sectional view looking along the line 4—4 of FIG. 3.

Although cloth 22 is shown in FIGS. 3 and 4 as being cinched with bracket 21 attached to a vertical support surface 23, the method and manner of attaching cloth 22 to bracket 21 is similar when bracket 21 is attached to a horizontal or other nonvertical support surface 23. Of course, the direction and effect of the gravitational force on rings 26 and 27 and cloth 22 will vary depending on the inclination of the support surface.

Figure 5:
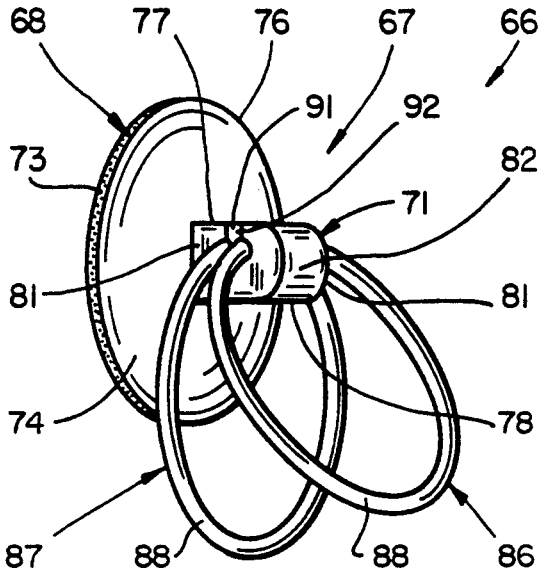
FIG. 5 is an isometric view of another embodiment of the bracket with gripping closed bands of the present invention.
Figure 6:
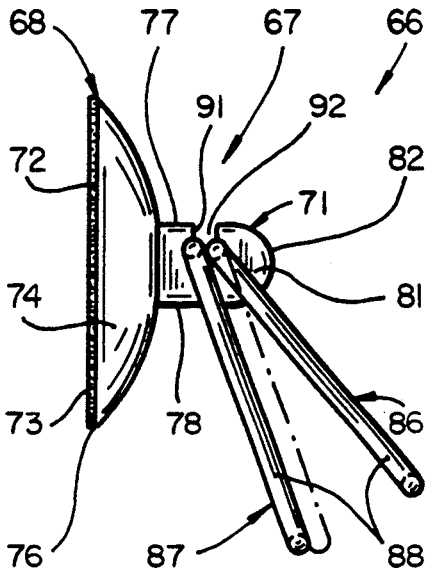
FIG. 6 is a side elevational view of the bracket with gripping closed bands shown in FIG. 5.

In another embodiment of the invention, a bracket 66 for use on a support surface 23 has a mounting element 67 which serves as a fastening means (See FIGS. 5 and 6). Like mounting element 28, mounting element 67 is made of a suitable material such as plastic, wood or metal and has opposite first and second side portions in the form of disk 68 and button 71. Disk 68 is substantially identical to disk 31, and has a planar first side surface 72 adapted to attach to support surface 23. Surface 72 has an adhesive layer 73 thereon which serves as means for removably attaching mounting element 67 to support surface 23. Disk 68 also has an arcuate second side surface 74 which is opposite first side surface 72 and adjoins the first side surface at an edge 76. Button 71 perpendicularly extends from the center of arcuate surface 74 and is generally rectangular in cross-section, with top and bottom surfaces 77 and 78, opposite side surfaces 81 and a rounded end 82 which is an extension of top and bottom surfaces 77 and 78 and is opposite disk surface 72.

Button 71 carries first and second planar gripping rings 86 and 87, which are substantially identical to rings 26 and 27 and are each formed from a generally closed band 88, in juxtaposition to each other. In this regard, button 71 has an inner surface 91 for forming a transverse opening 92 therein, inner surface 91 serving as means for coupling rings 86 and 87 thereto in an abutted position to permit the plane of first ring 86 to be moved from a first position inclined with respect to the plane of second ring 87 to a second position substantially parallel to second ring 87 (See FIG. 6). Opening 92 is substantially parallel to first surface 72 and T-shaped in cross-section, extending through side surfaces 81 with the base of the "T" open along top surface 77. The portion of opening 92 along top surface 77 permits a band 88 for each of rings 86 and 87 to be sequentially inserted in the opening 92. Alternatively, and not shown in the drawings, opening 92 could be in the form of an oblong or other shaped bore which extends through side surfaces 81, with rings 86 and 87 each capable of being opened to permit their bands 88 to be disposed in the opening.

In operation and use, adhesive layer 73 permits bracket 66 to be mounted to support surface 23. When attaching cloth 22 to bracket 66, cloth end portion **22*a* is looped upwardly behind and through second (or far) and first (or near) rings 87 and 86, around band 88 of first ring 86, between bands 88 of rings 86 and 87, and then downwardly behind second ring 87, with a cloth fold 22*c* formed around the encircled portion of first ring band 88. Because button 71 generally permits only pivotal movement of rings 86 and 87 with respect to each other, first ring 86 is not moved off center from second ring 87 to permit cloth end portion 22*a* to be slipped between bands 88 of first and second rings 86 and 87. Instead, first ring 86 is pivoted to an inclined position with respect to second ring 87 to allow cloth end portion 22*a* to be slipped between rings 86 and 87. As so attached, cloth 22 is retained by bracket 66 in substantially the same manner as bracket 21**.

Figure 7:
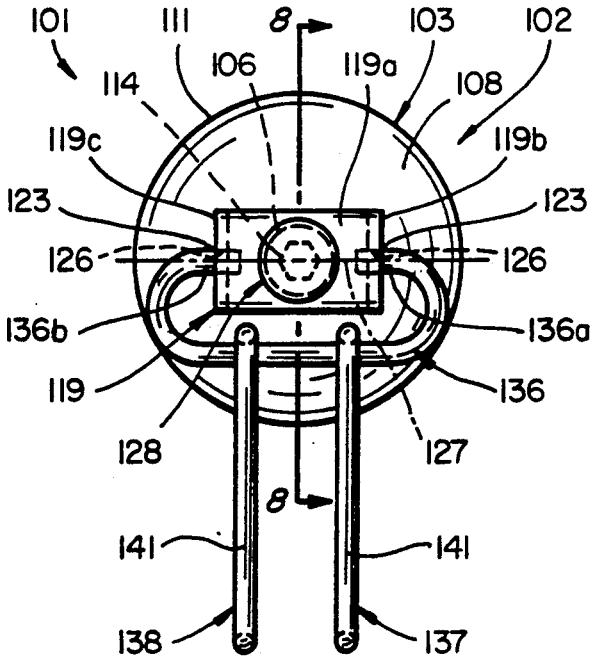
FIG. 7 is a front elevational view of another embodiment of the bracket with gripping closed bands of the present invention.
Figure 8:
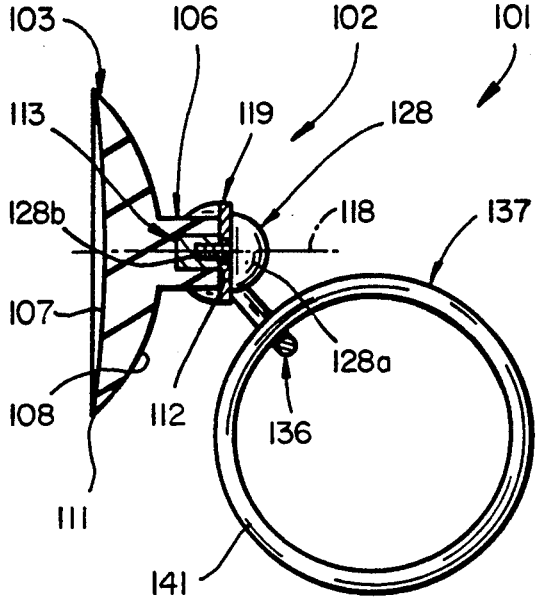
FIG. 8 is a cross-sectional view looking along the line 8—8 of FIG. 7.

In the preferred embodiment of the invention, a bracket 101 for removably fastening a cloth 22 to support surface 23 includes a fastening means in the form of a mounting element 102 adapted for engagement with the support surface (See FIGS. 7 and 8). Mounting element 102 has a suction cup 103 which serves as the first side portion and a button 106 which is included in opposite second side portion. Suction cup 103 is made of rubber, a resilient and flexible plastic or any other suitable material and serves as means for removably attaching mounting element 102 to support surface 23. Suction cup 103 has a first side surface 107 for attachment to support surface 23 and a second side or arcuate surface 108 which is opposite surface 107 and adjoins the first side surface at an edge 111. First surface 107 is generally planar when suction cup 103 is fastened to support surface 23.

Figure 9:
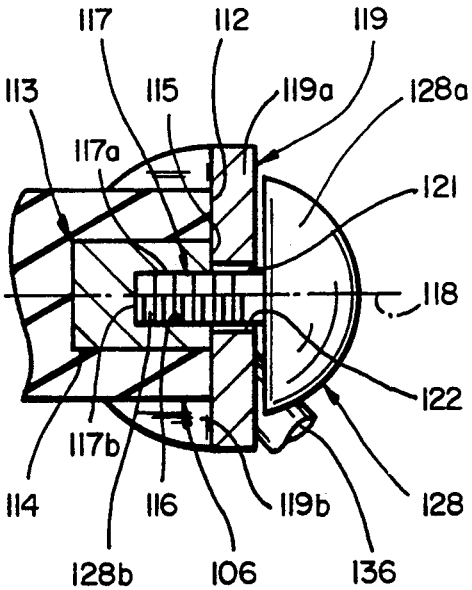
FIG. 9 is an enlarged view of a portion of FIG. 8.

Button 106, which can be formed integral with suction cup 103, projects and extends outwardly from the center of arcuate surface 108. The button is generally cylindrical in shape and has a planar end surface 112 which is generally parallel with first side surface 107 and with the plane formed by edge 111. Button 106 is formed with a socket 113 embedded therein which is made from a suitable material such as metal or plastic. Socket 113 has an outer surface 114 which is hexagonal in cross-section and an end surface 115 which is generally flush with button end surface 112 (See FIG. 9). Socket is also provided with a threaded bore 116 commencing in socket end surface 115 and formed by an inner surface 117 which includes a threaded side surface **117*a* and an inner end surface 117*b*. Threaded side surface 117*a* is generally circular in cross-section. A longitudinal axis 118 extends along the center of button 106, socket 113 and bore 116 and perpendicularly extends through surfaces 107 and 112**.

A plate member in the form of swivel plate 119 having a rectangular central portion **119*a* and aligned first and second side portions 119*b* and 119*c* formed at opposite ends of central portion 119*a* is mounted on button end surface 112. Side portions 119*b* and 119*c* are each semicircular in shape and formed at right angles to central portion 119*a*, the side portions being parallel to each other. Central portion 119*a* is provided with a bore 121 in the center thereof formed by a central inner surface 122. Inner surface 122 is generally circular in cross-section and is substantially centered on longitudinal axis 118. Side portions 119*b* and 119*c* are each provided with bores 123 therein formed by respective inner surfaces 126. Inner surfaces 126 are generally circular in cross-section and aligned along a transverse axis 127 which perpendicularly extends through side portions 119*b* and 119*c*. Axis 127 is generally parallel to the plane formed by central portion 119*a* and perpendicular to longitudinal axis 118**.

Mounting element 102 includes a bolt 128 with a semicircular-shaped head portion **128*a* and a threaded portion 128*b*, and made of metal, plastic or any other suitable material. Bolt threaded portion 128*b* extends through plate central bore 121 and is threadedly disposed in socket bore 116 for securing plate 119 to button 106. Means for securing bolt 128 within bore 116 includes button threaded side surface 117*a* and bolt threaded portion 128*b*. Plate 119 and bolt 128 are included in the second side portion of mounting element 102**.

Bolt 128, together with plate central inner surface 22, serves as swivel means for fastening plate 119 on button end surface 112 to permit plate 119 to swivel in opposite first and second directions about longitudinal axis 118. In this regard, bolt 128 is longitudinally sized so that the end of threaded portion **128*b* abuts inner end surface 117*b* to limit the travel of threaded portion 128*b* when the bolt is tightened. Bolt head portion 128*a* does not clamp down on plate 119 and thereby permits swivel movement of the plate about axis 118 with respect to button 106 and bolt 128. The noncircular cross-sectional configuration of socket outer surface 114 prevents socket 113 from undesirably rotating in button 106 as bolt 128 is tightened within socket 113**.

Mounting element 102 also includes an attachment band or ring 136 which is rigid and made of a suitable material such as plastic, wood or metal. Attachment ring 136 is generally in the shape of an elongated ring, having first and second end portions **136*a* and 136*b* which define an opening therein. The attachment ring 136 has a cross-section which is generally circular. End portions 136*a* and 136*b* are disposed in bores 123 in plate side portions 119*b* and 119*c*. Side inner surfaces 126 (which form bores 123) serve as coupling means for pivotly coupling attachment ring 136 to side portions 119*b* and 119*c* to permit pivoting of attachment ring 136 in opposite first and second directions about transverse axis 127**.

As can be seen from the foregoing, mounting element 101 includes means for swivelably coupling attachment ring 136 to button 106 which, in general, comprises bolt 128, plate 119 and socket 113. More specifically, this swivel coupling means includes the swivel means for fastening plate 119 on button end surface 112 and the coupling means for pivotly coupling attachment ring 136 to side portions **119*b* and 119*c***, each as discussed above.

Mounting element 102 serves to affix first and second planar gripping rings 137 and 138 to support surface 23, attachment ring 136 carrying rings 137 and 138 in juxtaposition to each other. Rings are substantially identical to rings 26 and 27 and are each formed from a generally closed band 141. Attachment ring 136 loops through rings 137 and 138, in substantially the same manner that attachment ring 56 loops through rings 26 and 27, for securing the rings to mounting element 102. When attachment ring 136 is so pivotly mounted to plate 119, the attachment ring and plate define a closed loop for carrying rings 137 and 138.

Figure 10:
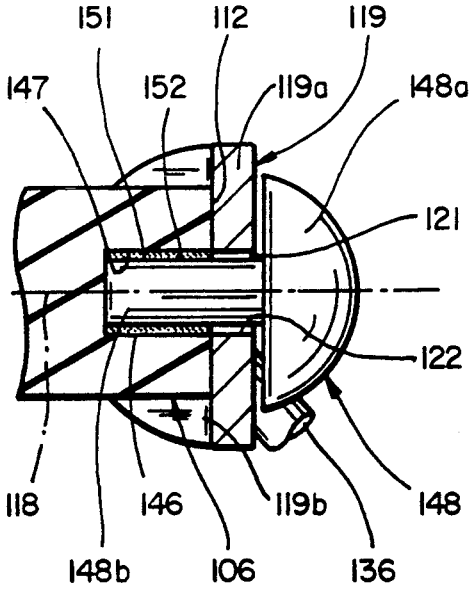
FIG. 10 is an enlarged fragmentary cross-sectional view of another embodiment of the bracket with gripping closed bands of the present invention.

In an alternate embodiment, button 106 of bracket 101 is formed without socket 113 therein. Instead, as illustrated in FIG. 10, button 106 is provided with a bore 146 therein which opens onto button end surface 112 and is generally centered on longitudinal axis 118. Bore 146 is formed by a generally circular-shaped and smooth inner surface 147. Mounting element 102 includes a bolt 148 having a semicircular-shaped head portion **148*a* and a cylindrical shank or stud portion 148*b* with a generally smooth outer surface 151. Stud portion 148*b* extends through plate central bore 121 and is disposed in bore 146, where it is secured to inner surface 147 therein by any suitable glue or cement 152 known to those skilled in the art. Cement 152 acts as means for securing bolt 148 within bore 146. Bolt 148 is sized and dimensioned similar to bolt 128 and, together with plate central inner surface 122, serves as swivel means for fastening plate 119 to button end surface 112 to permit plate 119 to swivel in opposite first and second directions about longitudinal axis 118**.

In operation and use, bracket 101 is mounted to support surface 23 by pressing suction cup 103 against the support surface and thereby substantially flattening first side surface 107 against the support surface. The inclusion of swivel plate 119 in mounting element 102 permits placement of the mounting element at any angular position on the support surface, with attachment ring 136 and gripping rings 137 and 138 attached thereto being swiveled or rotated about longitudinal axis 118 to the desired angular position with respect to support surface 23. With rings 137 and 138 so positioned on support surface 23, cloth 22 is attached to bracket 101 in substantially the same manner as discussed above with respect to attaching cloth 22 to bracket 21.

It is apparent from the foregoing that a new and improved bracket for removably fastening a flexible web article to a vertical or horizontal support surface is provided. The bracket can be removably attached to the support surface and is of a simple design. In addition, the bracket does not require the formation of holes or similar deformations in the article for fastening the article to the bracket.

More specifically, the gripping rings discussed above allow for secure gripping of a material as well as easy removal thereof for washing or disposal. The brackets allow for attachment and hanging of household or institutional (such as in a health care setting or school) textiles without sewing, snaps, clips or tying. The bracket is neither easily damaged, nor easily negotiated by a child, and, in certain embodiments, allows the gripped material to be used at all angles without undesirable torquing or tension on the bracket.

While only certain presently preferred embodiments have been described in detail, as will be apparent to those familiar with the art, certain changes and modifications can be made without departing from the scope of the invention as defined by the following claims.

What is claimed is:

1. A device for removably carrying a flexible sheet of material from a support surface comprising first and second rigid generally closed bands adapted to cinch the flexible sheet of material, the first and second closed bands having respective axially extending centerlines, a bracket adapted for attachment to the support surface and means for securing the first and second closed bands to the bracket so that they are in juxtaposed positions with respect to each other and their centerlines are generally coincident.

2. A device as in claim 1 wherein said closed bands are each rings having substantially the same diameter.

3. A device as in claim 1 wherein said first and second closed bands are each planar and wherein said securing means permits the plane of the first closed band to be moved from a first position inclined with respect to the plane of the second closed band to a second position substantially parallel to the second closed band plane.

4. A bracket assembly for removably fastening a flexible web article to a generally planar support surface comprising first and second planar generally closed bands of approximate equivalent size adapted to grip the flexible web article and fastening means adapted for engagement with the support surface for affixing the closed bands thereto, the fastening means including a first side portion having a surface adapted to attach to the support surface and an opposite second side portion which carries the closed bands in juxtaposition to each other, the second side portion including means for coupling the closed bands thereto in an abutted position to permit the plane of the first closed band to be moved from a first position inclined with respect to the plane of the second closed band to a second position substantially parallel to the second closed band plane, the coupling means including an inner surface in the second side portion which forms an opening therethrough, the closed bands having a portion disposed in the opening.

5. A bracket assembly for removably fastening a flexible web article to a generally planar support surface comprising first and second generally closed bands of approximate equivalent size adapted to grip the flexible web article and fastening means adapted for engagement with the support surface for affixing the closed bands thereto, the fastening means including a first side portion having a surface adapted to attach to the support surface and an opposite second side portion which carries the closed bands in juxtaposition to each other, the fastening means further including an attachment band and means for mounting the attachment band to the second side portion, the attachment band being looped through each of the closed bands.

6. A bracket assembly as in claim 5 wherein said second side portion and attachment band define a closed loop.

7. A bracket assembly as in claim 6 wherein said second side portion is provided with an axially extending bore therethrough which is substantially parallel to the surface of said first side portion and has opposite first and second openings and wherein said attachment band is generally rigid, a portion of the attachment band disposed in the bore and permitting the attachment band to pivot in opposite first and second directions about the bore axis.

8. A bracket assembly as in claim 7 wherein said attachment band has first and second end portions disposed in corresponding opposite bore openings.

9. A bracket assembly as in claim 6 wherein said attachment band is generally looped in shape.

10. A bracket assembly as in claim 9 wherein said attachment band is generally circular in shape.

11. A bracket assembly as in claim 5 wherein said attachment band is generally rigid and wherein said second side portion includes means for swivelably coupling said attachment band thereto.

12. A bracket assembly as in claim 11 wherein said second side portion includes an end surface substantially parallel to the surface of said first side portion and a first axis extending through and perpendicular to said first side portion surface and said end surface, and wherein said swivel coupling means comprises a plate member mounted on said end surface and means for fastening the plate member on the end surface to permit the plate member to swivel in opposite first and second directions about the first axis, the attachment band being coupled to the plate member.

13. A bracket assembly as in claim 12 wherein said plate member has first and second side portions and a second axis generally perpendicular to said first axis extending through and perpendicular to the first and second plate side portions and wherein said swivel coupling means includes means for pivotly coupling the attachment band to the first and second plate side portions to permit the attachment band to pivot in opposite first and second directions about the second axis.

14. A bracket assembly as in claim 12 wherein said second side portion is provided with a bore commencing in said end surface which is generally parallel to said first axis and wherein said means for fastening the plate member on the end surface includes an inner surface forming a bore through the plate member, a bolt extending through the plate member bore and disposed in the bore in the second side portion, and means for securing the bolt within the bore in the second side portion.

15. A device as in claim 1 wherein said bracket is generally circular in plan.

16. A device as in claim 1 wherein said bracket includes means for removably attaching the bracket to the support surface.

17. A device as in claim 16 wherein said means for removably attaching the bracket to the support surface comprises a suction cup.

18. A device as in claim 16 wherein said means for removably attaching the bracket to the support surface comprises an adhesive.

19. A device as in claim 16 wherein said means for removably attaching the bracket to the support surface comprises a magnet.

20. A device as in claim 1 wherein said bracket includes a first side portion which is generally flat and a second side portion which is elongate and extends outwardly from the first side portion.

21. A device for removably carrying a flexible sheet of material from a support surface comprising first and second rigid rings adapted to cinch the flexible sheet of material, the first and second rings having respective axially extending centerlines, a bracket adapted for attachment to the support surface and means for securing the first and second rings to the bracket so that they are in juxtaposed positions with respect to each other and their centerlines are generally coincident, the securing means permitting the plane of the first ring to be moved from a first position inclined with respect to the plane of the second ring to a second position substantially parallel to the second ring plane.

22. A bracket assembly for removably fastening a flexible web article to a generally planar support surface comprising first and second planar rings of approximate equivalent size adapted to grip the flexible web article and fastening means adapted for engagement with the support surface for affixing the rings thereto, the fastening means including a first side portion for removably attaching the fastening means to the support surface, an opposite projecting second side portion which extends outwardly from the first side portion, an attachment band which loops through each of the rings and means for mounting the attachment band to the second side portion.

23. A bracket assembly for removably fastening a flexible web article to a generally planar support surface comprising first and second planar rings of approximate equivalent size adapted to grip the flexible web article and fastening means adapted for engagement with the support surface for affixing the rings thereto, the fastening means including a first side portion for removably attaching the fastening means to the support surface, an opposite projecting second side portion which extends outwardly from the first side portion and has an end surfaces, a rigid attachment band which loops through each of the rings and means for swivelably coupling the attachment band to the second side portion, the swivel coupling means including a plate member mounted on the end surface and having first and second side portions and means for pivotly coupling the attachment band to the first and second plate side portions to permit the attachment band to pivot in opposite first and second directions.

* * * * *